US006322339B1

(12) United States Patent
Mitsunaga et al.

(10) Patent No.: US 6,322,339 B1
(45) Date of Patent: Nov. 27, 2001

(54) SCROLL COMPRESSOR

(75) Inventors: Toshihiko Mitsunaga, Saitama-ken; Kenzo Matsumoto, Gunma-ken; Kazuyoshi Sugimoto, Gunma-ken; Takahiro Nishikawa, Gunma-ken; Kazuaki Fujiwara, Gunma-ken; Kazuya Sato, Gunma-ken; Takashi Sato, Saitama-ken, all of (JP)

(73) Assignee: Sanyo Electric Co., Ltd., Moriguchi (JP)

( * ) Notice: Subject to any disclaimer, the term of this patent is extended or adjusted under 35 U.S.C. 154(b) by 0 days.

(21) Appl. No.: 09/156,021

(22) Filed: Sep. 17, 1998

(30) Foreign Application Priority Data

Sep. 17, 1997 (JP) ..... 9-252125
Sep. 26, 1997 (JP) ..... 9-261933
Sep. 30, 1997 (JP) ..... 9-267437

(51) Int. Cl.[7] ..... F03C 2/00

(52) U.S. Cl. ..... 418/55.2; 418/15; 418/55.1; 418/55.6; 418/94; 418/100

(58) Field of Search ..... 418/15, 55.1, 55.6, 418/100, 94, 55.2

(56) References Cited

U.S. PATENT DOCUMENTS 4,877,381 * 10/1989 Johnson et al. ..... 418/55.6
5,110,268 * 5/1992 Sakurai et al. ..... 418/55.6
5,345,785 * 9/1994 Sekigami et al. ..... 418/55.6
5,580,233 * 12/1996 Wakana et al. ..... 418/55.6
5,716,202 * 2/1998 Koyama et al. ..... 418/55.6

FOREIGN PATENT DOCUMENTS 0-049989 * 2/1990 (JP) ..... 418/55.6
09-042177 * 2/1990 (JP) ..... 418/55.6
403206388 * 9/1991 (JP) ..... 418/55.6
405164065 * 6/1993 (JP) ..... 418/55.6
406307358 * 1/1994 (JP) ..... 418/55.6

* cited by examiner

*Primary Examiner*—Thomas Denion
*Assistant Examiner*—Theresa Trieu
(74) *Attorney, Agent, or Firm*—Darby & Darby

(57) ABSTRACT

A highly reliable scroll compressor adapted to make the amount of a refrigerant taken in through a first suction inlet of a scroll compression element as equal as possible to that taken in through a second suction inlet of the scroll compression element so as to improve the intake efficiency, thereby suppressing pulsation and noise. If the sectional area of the inlet of a refrigerant passage through which a refrigerant taken in flows from an end of a swivel lap via the outer periphery thereof to the second suction inlet is denoted as A1, the sectional area of the inlet of the first suction inlet is denoted as A2, and the sectional area of the inlet of a communication groove is denoted as A3 when the gap between a stationary lap and the swivel lap of the scroll compression element reaches its maximum, then A1, A2, and A3 stay within a range defined by $1.5 \leqq A2/(A1+A3) \leqq 2.5$.

6 Claims, 8 Drawing Sheets

SCROLL COMPRESSOR

BACKGROUND OF THE INVENTION

1. Field of the Invention

The present invention relates to a scroll compressor mounted on an air conditioner, a refrigerating machine, etc. and, more particularly, to a scroll compressor adapted to discharge compressed gas, which has been compressed in a plurality of compression chambers formed by the engagement between a stationary scroll and a swivel scroll, out of a hermetic housing.

2. Description of Related Art

A scroll compressor 1A employed for a refrigerating cycle of an air conditioner has a composition, for example, shown in FIG. 6. A cylindrical hermetic housing 1 with its both ends closed includes an electric element 2 and a scroll compression element 3. The electric element 2 is composed of a stator 4 secured to the inner wall surface of the hermetic housing 1 and a rotor 5 rotatably supported in the stator 4, a rotating shaft 6 being connected to the rotor 5 in a penetrating fashion. One end of the rotating shaft 6 is rotatably supported on a support frame 7 partly constituting the scroll compression element 3. The other end of the rotating shaft 6 juts out of the rotor 5, a lubricating portion 8 being connected to the distal end thereof. An oil inlet pipe 9 is connected to an end of the lubricating portion 8. The end of the intake side of the oil inlet pipe 9 is extended downward so that it is 1. submerged in a lubricant "b" contained in the hermetic housing An oil feed passage 10 for sucking in the lubricant "b" from the lubricating portion 8 and supplying it is bored in the rotating shaft 6 in the axial direction. The lubricant passes through the oil feed passage 10 to be supplied to sliding parts such as the support frame 7, then it is recirculated.

The central part of one end of the rotating shaft 6 supported by the support frame 7 in the penetrating manner is formed as a pin or crank 11 provided eccentrically in relation to the axial center of the rotating shaft 6. A swivel scroll 12 is connected to the pin 11. The swivel scroll 12 is formed into a discoid shape. A boss hole 13 for connection with the pin 11 is formed at the center of one side surface of the swivel scroll 12, while a spiral swivel lap 14 is integrally formed on the other side surface of the swivel scroll 12.

Joined to the support frame 7 is a stationary scroll 15. The stationary scroll 15 has a spiral stationary lap 16 formed on a portion thereof opposed to the swivel scroll 12, and also a plurality of compression chambers 17 formed between itself and the swivel lap 14.

A refrigerant gas introduced into the outer peripheral portion of the scroll compression element 3 via an intake pipe 18 from outside the hermetic housing 1 is taken in through two inlets of the scroll compression element 3, namely, a first suction inlet (not shown) and a second suction inlet (not shown) that is located oppositely with respect to the first suction inlet and that is in communication therewith through a communication groove connected to the first suction inlet. Then, the refrigerant gas is compressed in the compression chambers 17 and the volume thereof is gradually reduced as it moves toward the center before it is discharged into the hermetic housing 1 through a discharge port provided at the center of one side surface of the stationary scroll 15, thus separating the lubricant accompanied the refrigerant gas in this space so as to reduce pulsation.

The compressed gas discharged through the discharge port 19 into the hermetic housing 1 flows through passages (not shown) provided in the stationary scroll 15 and the support frame 7 as indicated by the white arrows and reaches the side of electric element 2. And the lubricant in the refrigerant gas is further separated primarily by the centrifugal force generated by the rotation of the rotor 5. The refrigerant gas from which the lubricant has been separated is discharged out of the hermetic housing 1 through a discharge pipe 20. The separated lubricant flows as indicated by the black arrows and accumulates at the bottom of the hermetic housing 1 and it is recirculated.

However, there has been a problem in that, if the amount of the refrigerant taken in through a first suction inlet (not shown) of the scroll compression element 3 is different from that taken in through the second suction inlet (not shown) thereof, then the intake efficiency deteriorates, resulting in more pulsation with consequent noise and deteriorated reliability.

SUMMARY OF THE INVENTION

Accordingly, it is an object of the present invention to provide a highly reliable scroll compressor adapted to make the amount of a refrigerant taken in through the first suction inlet of the scroll compression element 3 mentioned above as equal as possible to that taken in through the second suction inlet thereby to improve the intake efficiency so as to control pulsation or noise.

The inventors have zealously studied the aforesaid problem and found the following solution thereto, leading to the fulfillment of the present invention. To be more specific, if the sectional area of the inlet portion of a particular refrigerant passage is denoted by A1, the sectional area of the inlet portion of the first suction inlet is denotes by A2, and the sectional area of the inlet portion of a communication groove is denoted by A3 when the gap between the stationary lap and the swivel lap reaches the maximum thereof, then the problem can be solved by controlling these values to the range specified by a formula (1) given below, and/or by providing a throttle portion extending from an inlet of the communication groove to a particular position and by setting a sectional area a3 of the communication groove from the throttle portion to a second suction inlet to a value smaller than the sectional area A3.

A scroll compressor according to claim 1 of the present invention has an electric element and a scroll compression element driven by the electric element that are placed in a hermetic housing wherein the scroll compression element includes a stationary scroll having a spiral stationary lap and a swivel scroll having a spiral swivel lap that revolves with respect to the stationary scroll by being driven by the electric element, the stationary scroll and the swivel scroll are meshed with each other to form a plurality of compression chambers, a refrigerant gas, which has been introduced from outside the hermetic housing into a refrigerant introducing portion of the outer peripheral portion of the scroll compression element, is taken in through a first suction inlet and a second suction inlet that is located in a position relative to the first suction inlet and in communication therewith through a communication groove connected with the first suction inlet, and compressed in the compression chambers before it is discharged out of the hermetic housing; and wherein, if the sectional area of the inlet of a refrigerant passage through which a refrigerant taken in flows from an end of the swivel lap via the outer periphery thereof to the second suction inlet is denoted as A1, the sectional area of the inlet of the first suction inlet is denoted as A2, and the sectional area of the inlet of the communication groove is denoted as A3when the gap between the stationary lap and the swivel lap reaches the maximum thereof, then A1, A2, and A3 stay within a range defined by a formula (1) given below:

$$1.5 \leqq A2/(A1+A3) \leqq 2.5 \quad \text{Formula (1)}$$

A scroll compressor according to claim 2 of the present invention has an electric element and a scroll compression element driven by the electric element that are placed in a hermetic housing, wherein the scroll compression element includes a stationary scroll having a spiral stationary lap and a spiral swivel lap that revolves with respect to the stationary scroll by being driven by the electric element, the stationary scroll and the spiral swivel lap are meshed with each other to form a plurality of compression chambers, a refrigerant gas, which has been introduced from outside the hermetic housing into a refrigerant introducing portion of the outer peripheral portion of the scroll compression element, are taken in through a first suction inlet and a second suction inlet that is located in a position relative to the first suction inlet and in communication therewith through a communication groove connected with the first suction inlet, and compressed in the compression chambers before it is discharged out of the hermetic housing; and wherein, if the length between two points at which a line passing through the center of the rotational axis of the electric element and also the center of the refrigerant introducing portion intersects with a line running through the center of the width of the communication groove is denoted as L, and a throttle portion is provided so that it extends from the inlet of the communication groove to a point of L/4, then a sectional area a3 of the communication groove from the throttle portion to the second suction inlet is made smaller than a sectional area A3 of the inlet.

According to a further aspect of the invention described in claim 3 of the invention, the aforesaid a3 and A3 stay within a range defined by a formula (2) given below in the scroll compressor described in claim 2:

$$0.8 \leqq a3/A3 \leqq 1.0 \quad \text{Formula (2)}$$

According to another aspect of the invention described in claim 4, in the scroll compressor described in claim 1, if the length between two points at which a line passing through the center of the rotational axis of the electric element and also the center of the refrigerant introducing portion intersects with a line running through the center of the width of the communication groove is denoted as L, and a throttle portion is provided so that it extends from the inlet of the communication groove to a point of L/4, then a sectional area a3 of the communication groove from the throttle portion to the second suction inlet is made smaller than a sectional area A3 of the inlet.

According to another aspect of the invention described in claim 5 of the invention, the aforesaid a3 and A3 stay within a range defined by a formula (3) given below in the scroll compressor described in claim 4:

$$0.8 \leqq a3/A3 \leqq 1.0 \quad \text{Formula (3)}$$

A scroll compressor according to claim 6 of the present invention is equipped with an electric element and a scroll compression element driven by a rotating shaft of the electric element that are placed in a hermetic housing, a lubricant contained in the hermetic housing, and a lubricating portion provided on an end of the rotating shaft to supply the lubricant from the lubricating portion to respective sliding portions via an oil feed passage provided in the rotating shaft and to circulate it for reuse, wherein: an oil injection mechanism composed of an oil nozzle for injecting oil and a valve for opening/closing an oil feed passage inlet of the oil nozzle by the elasticity of a spring is provided in the vicinity of the position where a refrigerant gas is sucked into the scroll compression element from outside the hermetic housing, so that the valve opens the oil feed passage inlet to inject the lubricant held in the hermetic housing into the scroll compression element if the difference between the pressure in the hermetic housing that acts on the rear surface of the valve and the pressure in the vicinity of the position, where the refrigerant gas is taken in, that acts on the outlet of the oil nozzle is small, whereas the valve closes the oil feed passage inlet to stop the injection of the lubricant if the pressure differential is large.

A scroll compressor described in claim 7 of the present invention is equipped with an electric element and a scroll compression element driven by a rotating shaft of the electric element that are placed in a hermetic housing, a lubricant contained in the hermetic housing, and a lubricating portion provided on an end of the rotating shaft to supply the lubricant from the lubricating portion to respective sliding portions via an oil feed passage provided in the rotating shaft and circulate it for reuse, wherein: an oil injection mechanism composed of an oil nozzle for injecting oil and a valve for opening/closing an oil feed passage inlet of the oil nozzle by the elasticity of a spring is provided in the vicinity of a communication passage extending between a first suction inlet for taking in a refrigerant gas into the scroll compression element from outside the hermetic housing and a second suction inlet located in a position opposed to the first suction inlet and in communication with the first suction inlet through the communication passage, so that the valve opens the oil feed passage inlet to inject the lubricant held in the hermetic housing into the communication passage if the difference between the pressure in the hermetic housing that acts on the rear surface of the valve and the pressure in the communication passage that acts on the outlet of the oil nozzle is small, whereas the valve closes the oil feed passage inlet to stop the injection of the lubricant if the pressure differential is large.

According to yet another aspect of the invention described in claim 8 of the present invention, the injection amount of the lubricant is 0.1 to 3% for the elimination volume per unit time in the scroll compressor described in claim 6 or 7.

According to yet another aspect of the invention described in claim 9 of the present invention, the valve opens the oil feed passage inlet to inject the lubricant if the pressure differential is less than the range of 4 to 8 kgf/cm$^2$ in the scroll compressor described in claims 6 to 8.

According to a further aspect of the invention described in claim 10 of the invention, the lubrication system in the lubricating portion in the scroll compressor described in claims 6 to 9 utilizes pressure differential or an oil pump.

According to a further aspect of the invention described in claim 11 of the invention, in the scroll compressor described in claims 7 to 10, the oil injection mechanism is provided in the vicinity of the communication passage extending from a line connecting the center of the rotating shaft and the center of the first suction inlet to a line drawn 90 degrees away from the center of the rotating shaft toward the second suction inlet, using the foregoing line as the baseline.

A scroll compressor according to claim 12 of the invention is equipped with an electric element which is provided with its rotating shaft laterally oriented and a scroll compression element driven by the electric element, both electric element and scroll compression element being placed in a hermetic housing, a support frame that is installed in the hermetic housing to support the scroll compression element and that is provided with a bearing portion for rotatably supporting the rotating shaft at the center thereof, a lubricant held in the hermetic housing, and a differential pressure lubricating portion provided on an end of the rotating shaft, wherein the scroll compression element includes a stationary scroll having a discharge port of compressed gas at the center thereof and a spiral lap on the rear surface thereof, and a swivel scroll having a spiral lap that revolves with respect to the stationary scroll by being driven by the electric element, the stationary scroll and the swivel scroll being meshed with each other to form a plurality of compression chambers, a refrigerant gas, which has been taken in from outside the hermetic housing, is compressed in the compression chambers and discharged into the hermetic housing through the discharge port before it is discharged out of the hermetic housing; and wherein the sliding surface of the bearing is gas-sealed by the lubricant, and a refrigerant gas intake side, the rear surface of the swivel scroll, and the support frame are placed in communication to set the pressure thereamong lower than the pressure in the hermetic housing so as to feed the lubricant from the lubricating portion via the oil feed passage provided in the rotating shaft to respective sliding portions including the bearing thereby to circulate the lubricant for reuse.

According to a further aspect of the invention described in claim 13 of the invention, in the scroll compressor described in claim 12, a pin which is provided on the distal end of the rotary shaft and the center of which is eccentric to the axial center of the rotating shaft is inserted in a boss hole drilled at the center of the rear surface of the swivel scroll, and the boss hole and the sliding portion of the pin are gas-sealed with the lubricant sucked in from the lubricating portion.

According to a further aspect of the invention described in claim 14 of the invention, in the scroll compressor described in claim 12 or 13, a small hole is provided that extends from the oil feed passage to the sliding surface of the bearing, and a spiral groove is provided in the surface of the rotating shaft on the side of the electric element from the small hole so that the lubricant, which has passed through the small hole, flows through the groove to lubricate the sliding surface and to gas-seal the sliding surface on the side of the scroll compression element from the small hole.

According to a further aspect of the invention described in claim 15 of the invention, in the scroll compressor described in claim 12 or 13, a small hole that extends from the oil feed passage to the sliding surface of the bearing is provided in the vicinity of the end of the bearing on the side of the electric element, and a spiral groove that extends in the opposite direction from the rotational direction of the rotating shaft is provided in the surface of the rotating shaft on the side of the scroll compression element from the small hole in such a manner that the end point of the spiral groove is positioned within the bearing so that the lubricant, which has passed through the small hole, flows through the groove to lubricate the sliding surface and to gas-seal the sliding surface on the side of the scroll compression element from the end point.

According to a further aspect of the invention described in claim 16 of the invention, in the scroll compressor described in claims 12 to 15, the lubricating portion is equipped with an auxiliary support frame having an auxiliary bearing that is installed in the hermetic housing to rotatably support the rotating shaft and that has an oil introducing pipe attached thereto; wherein a bearing is installed between the auxiliary support frame and the rotating shaft, and the receiving portion of the bearing is provided on the auxiliary bearing.

According to a further aspect of the invention described in claim 17 of the invention, in the scroll compressor described in claims 12 to 16, the gap between the rotating shaft and the sliding portion of the auxiliary bearing is adjusted to prevent gas from entering the lubricant.

According to a further aspect of the invention described in claim 18 of the invention, in the scroll compressor described in claims 12 to 17, the stationary scroll and the swivel scroll are made of aluminum or an aluminum alloy.

DESCRIPTION OF THE PREFERRED EMBODIMENTS

Figure 1:
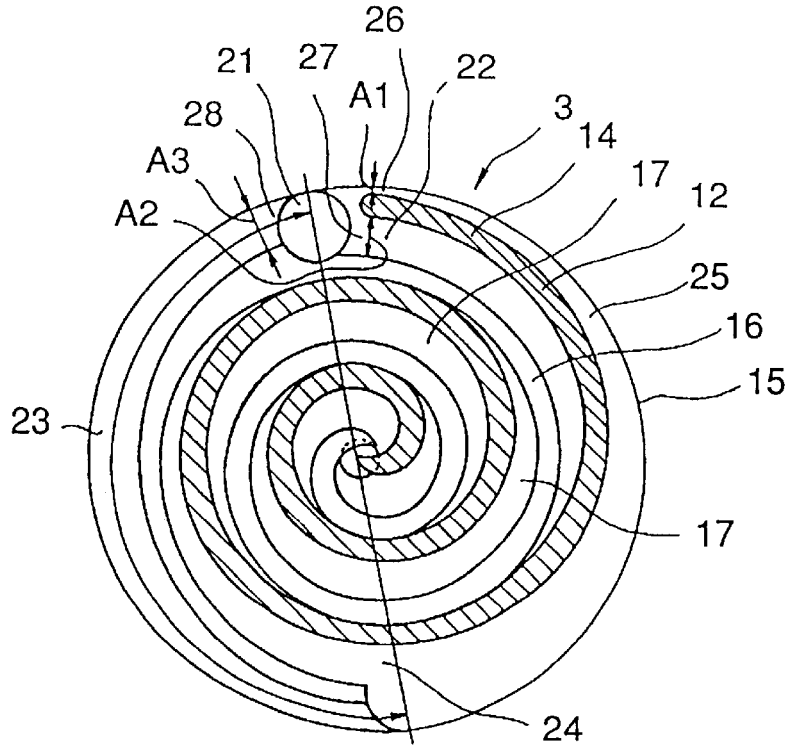
FIG. 1 is a schematic representation illustrative of the relationship mainly among a stationary lap, a swivel lap, a refrigerant introducing portion, a first suction inlet, a communication groove, and a second suction inlet when the gap between the stationary lap and the swivel lap of a scroll compressor in accordance with the present invention has reached its maximum.
Figure 2:
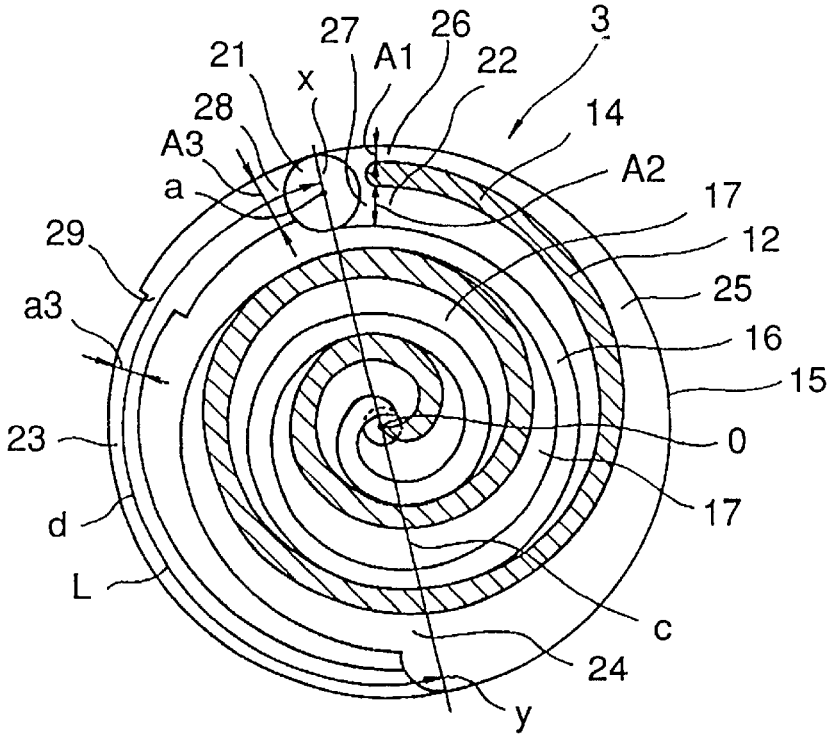
FIG. 2 is a schematic representation illustrative of the relationship mainly among a stationary lap, a swivel lap, a refrigerant introducing portion, a first suction inlet, a communication groove, and a second suction inlet when the gap between the stationary lap and the swivel lap of another scroll compressor in accordance with the present invention has reached its maximum.

The embodiments of the present invention will now be described in detail in conjunction with FIG. 1 and FIG. 2. FIG. 1 is a schematic representation illustrative of the relationship mainly among a stationary lap, a swivel lap, a refrigerant introducing portion, a first suction inlet, a communication groove, and a second suction inlet when the gap between the stationary lap and the swivel lap of a scroll compressor in accordance with the present invention has reached its maximum. FIG. 2 is a schematic representation illustrative of the relationship mainly among a stationary lap, a swivel lap, a refrigerant introducing portion, a first suction inlet, a communication groove, and a second suction inlet when the gap between the stationary lap and the swivel lap of another scroll compressor in accordance with the present invention has reached its maximum. In FIG. 1 and FIG. 2, the components denoted by the like reference numerals as those in FIG. 6 have the same functions as those of the components assigned the like reference numerals that have been described in conjunction with FIG. 6.

As shown in FIG. 1, a scroll compression element 3 includes a stationary scroll 15 having a spiral stationary lap 16 and a swivel scroll 12 having a spiral swivel lap 14 that revolves with respect to the stationary scroll 15 by being driven by the foregoing electric element 2 (not shown in FIG. 1 or 2). The stationary scroll 15 and the swivel scroll 12 are engaged with each other to form a plurality of compression chambers 17.

A refrigerant gas introduced from outside the foregoing hermetic housing 1 (not shown in FIG. 1 or 2) into a refrigerant introducing portion 21 of the outer peripheral of the scroll compression element 3 is taken in through a first suction inlet 22, which is formed between the swivel lap 14 and the stationary lap 16, and a second suction inlet 24 that is oppositely positioned from the first suction inlet 22 and that is placed in communication by a communication groove 23 connected to the first suction inlet 22. The introduced refrigerant gas is compressed in the compression chambers 17 and the volume thereof is gradually reduced as it moves toward the center, then it is discharged through the discharge port 19 (not shown in FIG. 1 or 2) provided at the center of the other side surface of the stationary scroll 15.

Approximately half of the refrigerant gas introduced into the refrigerant introducing portion 21 is taken in through the first suction inlet 22 and the rest is taken in through the second suction inlet 24 via a plurality of passages. The first half of the refrigerant gas is taken in through the second suction inlet 24 via a refrigerant passage 25 extending from an end of the swivel lap 14 along the outer circumference thereof to the inner surface of the outermost circumference of the stationary scroll 15. The second half of the refrigerant gas is taken in through the second suction inlet 24 via the communication groove 23.

In order to make the amount of the refrigerant introduced through the first suction inlet 22 as equal as possible to that introduced through the second suction inlet 24, it is important to control the values of A1, A2, and A3 to the range defined by the foregoing formula (1), where the sectional area of an inlet 26 of the refrigerant passage 25 is denoted as A1, the sectional area of an inlet 27 of the first suction inlet 22 is denoted as A2, and the sectional area of an inlet 28 of the communication groove 23 is denoted as A3.

Figure 6:
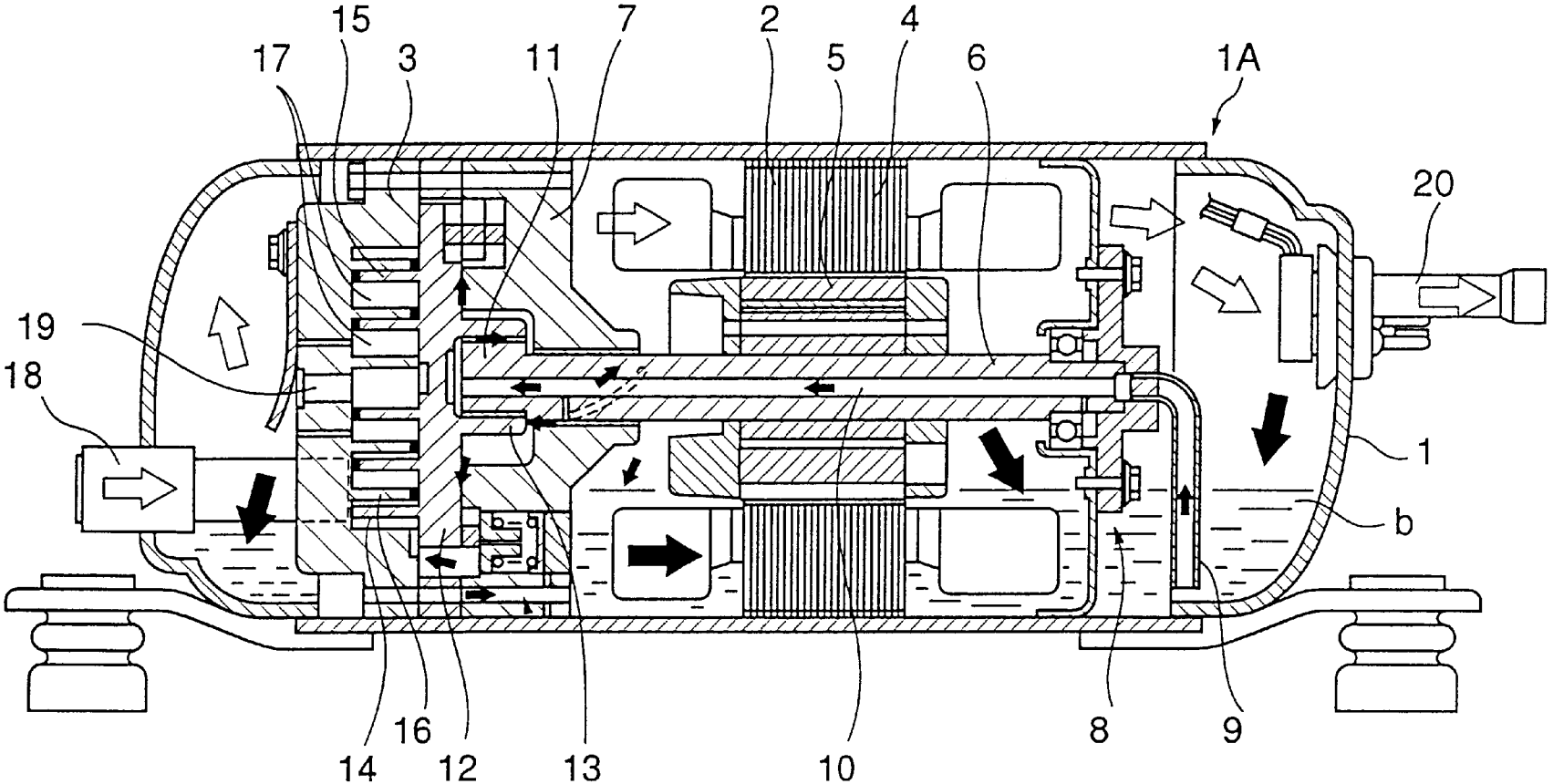
FIG. 6 is a sectional view showing the entire composition of a conventional scroll compressor.

Except for the constitution described above, the scroll compressor in accordance with the invention shares the same structure as that of the scroll compressor 1A shown in FIG. 6.

If [A2/(A1+A3)] given by the formula (1) is below 1.5 or exceeds 2.5, then the balance between the amount of the refrigerant introduced through the first suction inlet 22 and that introduced through the second suction inlet 24 is disturbed. This leads to deteriorated intake efficiency and increased pulsation with resultant noise and also leads to deteriorated reliability.

Figure 3:
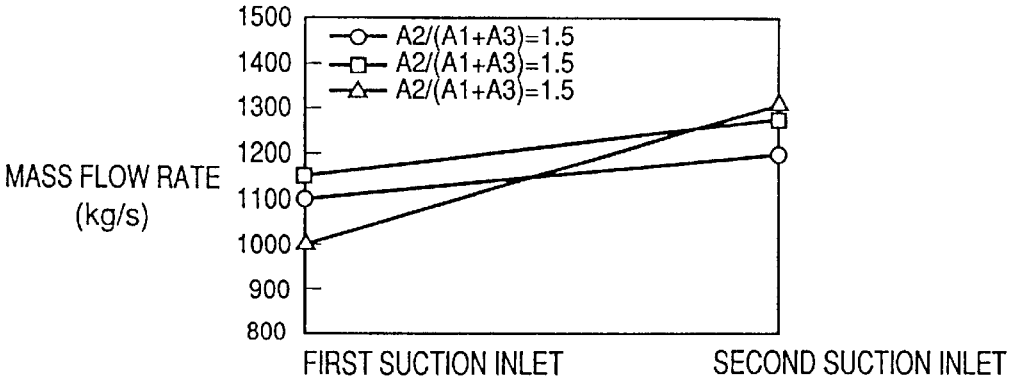
FIG. 3 is a graph showing the mass weight (kg/s) of a refrigerant taken in through the first suction inlet and the second suction inlet.

FIG. 3 shows the mass flow rate (kg/s) of the refrigerant taken in through the first suction inlet 22 and the second suction inlet 24 when the value of [A2/(A1+A3)] is 1.5, 2.0, and 2.5, respectively. It can be seen that the amount of the refrigerant introduced through the first suction inlet 22 and that introduced through the second suction inlet 24 are in good balance and nearly equal especially when the value of [A2/(A1+A3)] is 1.5 or 2.0.

As shown in FIG. 2, in another scroll compressor in accordance with the invention, in order to make the amount of the refrigerant introduced through the first suction inlet 22 as equal as possible to that introduced through the second suction inlet 24, a throttle portion 29 is provided so that it extends from the inlet 28 of the communication groove 23 to the point of L/4, where the length between two points (x and y) at which a line "c" passing through a center O of the rotating shaft 6 and the electric element 2 (not shown in FIG. 1 or 2) and also a center "a" of the refrigerant introducing portion 21 intersects with a line "d" passing through the center of the width of the communication groove 23 is denoted as L. The sectional area a3 of the communication groove 23 from the throttle portion 29 to the second suction inlet 24 is set to a smaller value than that of the sectional area A3 of the inlet 24.

Preferably, the ratio of a3/A3 is set to the range defined by the foregoing formula (3).

Except for the constitution described above, another scroll compressor in accordance with the invention shares the same structure as that of the scroll compressor 1A shown in FIG. 6.

Figure 4:
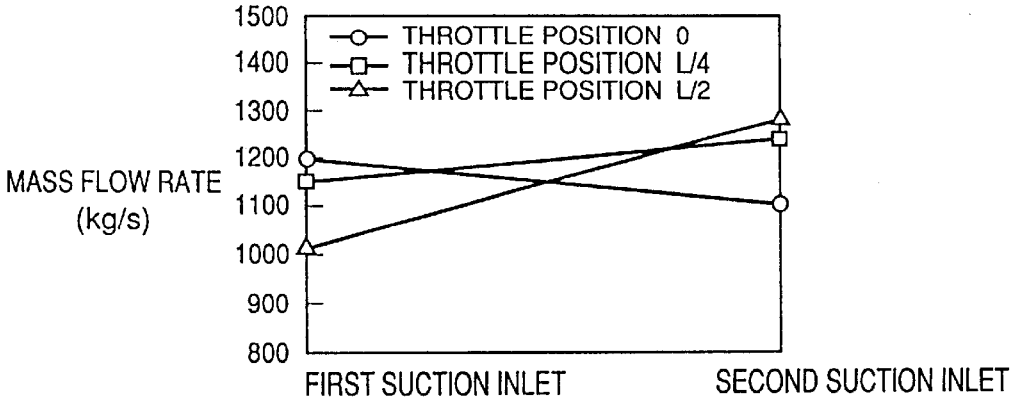
FIG. 4 is a graph showing the mass weight (kg/s) of a refrigerant taken in through the first suction inlet and the second suction inlet.

FIG. 4 shows the mass flow rate (kg/s) of the refrigerant taken in through the first suction inlet 22 and the second suction inlet 24 when the value of [A2/(A1+A3)] is set to 2.0, and the position where the throttle portion 29 is provided is set to 0 (immediately behind the refrigerant introducing portion 21), L/4, and L/2, respectively. It can be seen that the balance is disturbed when the throttle portion 29 is provided at the point L/2, whereas good balance is obtained when it is provided so that it extends from the inlet 28 of the communication groove 23 to the position of L/4.

Figure 5:
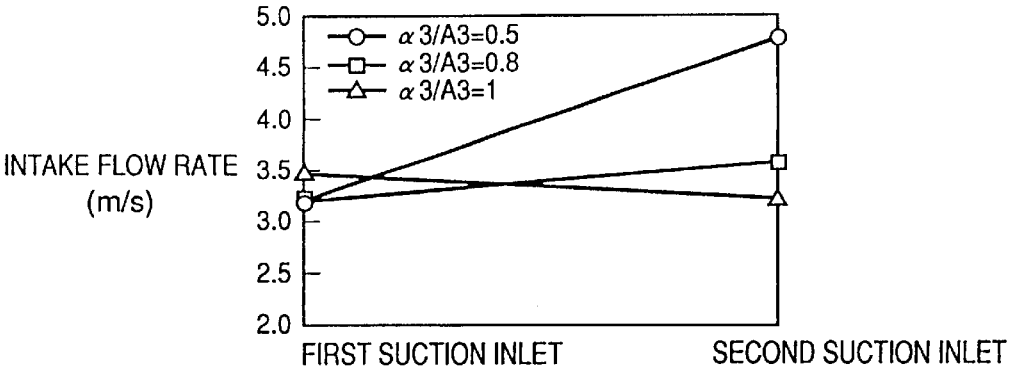
FIG. 5 is a graph showing the intake flow rate (m/s) of the refrigerant introduced through the first suction inlet and the second suction inlet.

FIG. 5 shows the suction flow rate (m/s) of the refrigerant introduced through the first suction inlet 22 and the second suction inlet 24 when the value of [A2/(A1+A3)] is set to 2.0, the throttle portion 29 is provided so that it extends to the position of L/4, and the ratio of a3/A3 is set to 0.5, 0.8, and 1, respectively. It can be seen that the balance is disturbed when the ratio of a3/A3 is set to 0.5, whereas good balance is obtained when the ratio of a3/A3 is set to 0.8 or 1.0.

The above description of the present invention refers to a horizontal type scroll compressor. The scroll compressor in accordance with the invention, however, is not limited to the horizontal type; the invention is applicable also to a vertical scroll compressor or other types of scroll compressors.

The scroll compressor in accordance with the invention is designed to make the amount of the refrigerant introduced through the first suction inlet as equal as possible to that introduced through the second suction inlet, so that the intake efficiency is improved and pulsation or noise can be controlled. This leads to higher reliability and permits stable operation of the scroll compressor.

Another aspect of the present invention will now be described in conjunction with FIG. 7 through FIG. 10.

Figure 10:
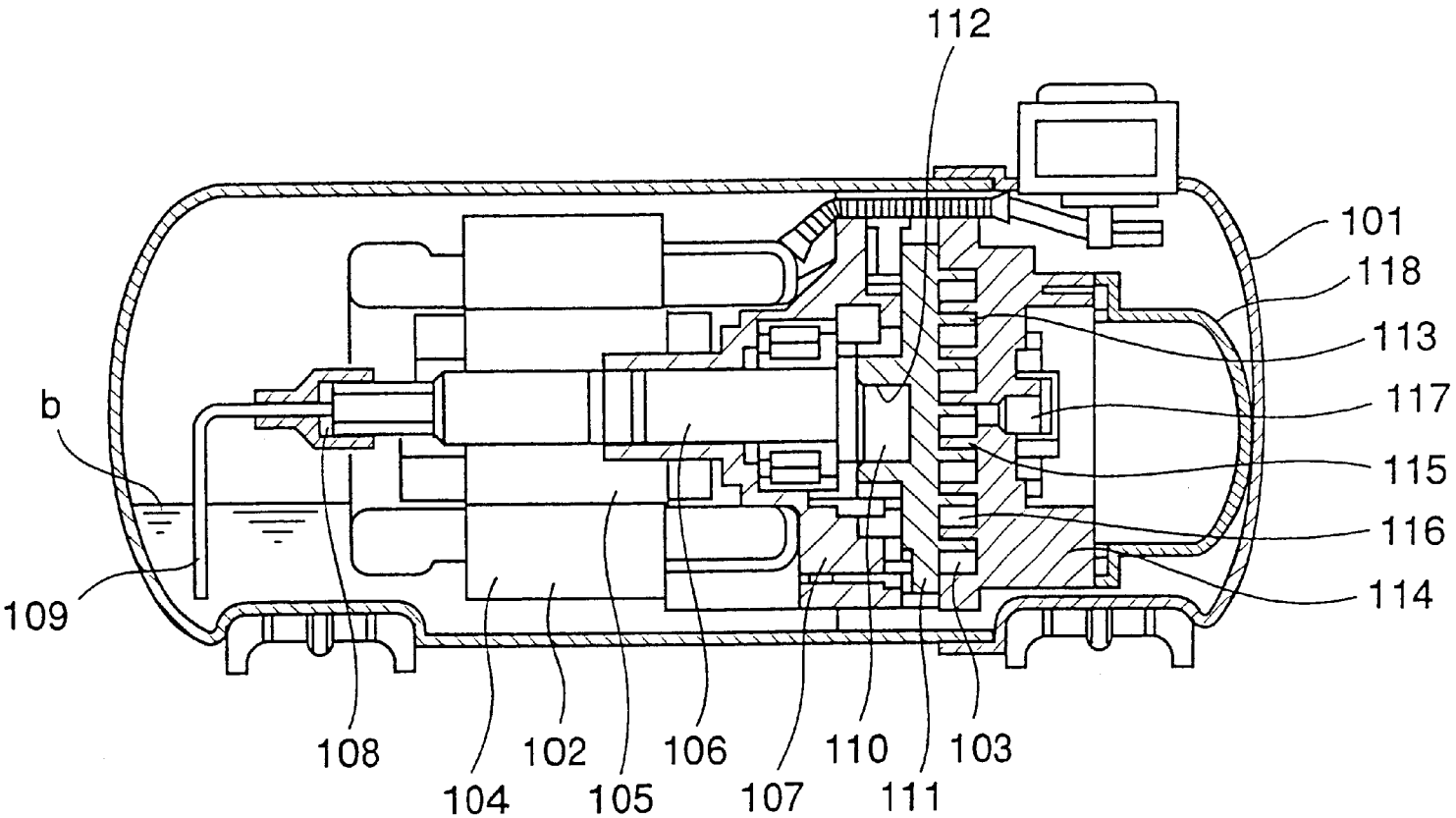
FIG. 10 is a sectional view showing the entire composition of another conventional scroll compressor.

A scroll compressor employed for a refrigerating cycle of an air conditioner or the like is constructed as shown in FIG. 10 as disclosed, for example, in Japanese Examined Patent Publication No. 7-99150.

A cylindrical hermetic housing 101 with its both ends closed includes an electric element 102 and a scroll compression element 103 therein. The electric element 102 is composed of a stator 104 secured to the inner wall surface of the hermetic housing 101 and a rotor 105 rotatably supported in the stator 104, a rotating shaft 106 being connected to the rotor 105 in a penetrating fashion. One end of the rotating shaft 106 is rotatably supported on a support frame 107 partly constituting the scroll compression element 103. The other end of the rotating shaft 106 juts out of the rotor 105, a displacement pump 108 such as a trochoid pump, rotary pump, or reciprocating pump being connected to the distal end thereof. An oil inlet pipe 109 is connected to an end of the displacement pump 108. The end of the intake side of the oil inlet pipe 109 is extended downward so that it is submerged in a lubricant "b" contained in the hermetic housing 101.

An oil feed passage for taking in the lubricant "b" by the displacement pump 108 is bored in the rotating shaft 106 in the axial direction, so that the lubricant is recirculated after it is supplied to sliding parts such as the support frame 107.

The central part of one end of the rotating shaft 106 supported by the support frame 107 in the penetrating manner is formed as a pin or crank 110 provided eccentrically in relation to the axial center of the rotating shaft 106. A swivel scroll 111 is connected to the pin 110. The swivel scroll 111 is formed into a discoid shape, a boss hole 112 for connection with the pin 110 being formed at the center of one side surface thereof, while a spiral lap 113 is integrally formed on the other side surface of the swivel scroll 111.

Joined to the support frame 107 is a stationary scroll 114. The stationary scroll 114 has a spiral lap 115 formed on a portion thereof opposed to the swivel scroll 111, and also a plurality of compression chambers 116 formed between itself and the lap 113. These compression chambers 116 such in a refrigerant gas through the outer peripheral portion thereof and reduces the volumes as they move toward the center so as to compress the refrigerant gas.

A discharge port 117 is formed at the center of the stationary scroll 114. The stationary scroll 114 is provided with a muffler 118 that surrounds the outer side of the discharge port 117.

There has also been proposed a horizontal type scroll compressor under Japanese Examined Patent Publication No. 3-175186. This type does not employ the pump for supplying a lubricant, and it discharges compressed gas into a hermetic housing; it has a through hole in the swivel scroll to communicate an appropriate compression chamber among the scroll compression elements, the rear surface of the swivel scroll, and the support frame so as to set the pressure among them to an appropriate medium pressure, e.g. 8 to 9 kg/cm$^2$ that is lower than the pressure, e.g. 15 to 25 kg/cm$^2$, in a hermetic housing. By utilizing the pressure differential, a lubricant is sucked up and passed through the oil feed passage provided in the rotating shaft to be supplied to respective sliding parts including a support frame. The swivel scroll is pressed against a stationary scroll by the foregoing pressure to bring them into contact so as to provide gas seal thereby to compress the refrigerant gas.

However, regardless of whether the lubrication is conducted using a pump or pressure differential, there has been the problem described below. The amount of a lubricant supplied varies according to the number of revolutions of the rotating shaft; therefore, a sufficient amount of the lubricant is supplied as long as the number of revolutions is sufficiently large, but if the number of revolutions decreases, then the amount of the lubricant supplied decreases. As a result, the an insufficient amount of the lubricant is supplied, for example, to a plurality of the compression chambers 116 formed between the lap 115 and the lap 113, and the lubricating and sealing performance deteriorates with resultant deterioration of the whole performance, meaning deteriorated reliability.

To solve the problem, there is provided a highly reliable scroll compressor equipped with an oil injection mechanism having a simple constitution in accordance with another aspect of the present invention. This scroll compressor makes it possible to easily avoid insufficient supply of the lubricant to the compression chambers even when the number of revolutions of the rotary shaft decreases.

The inventors have enthusiastically studied to solve the problem and found a solution thereto, which has led to the accomplishment of the present invention. According to the solution, a separate oil injection mechanism having a particular composition is installed in a particular position in the scroll compression element.

Figure 7:
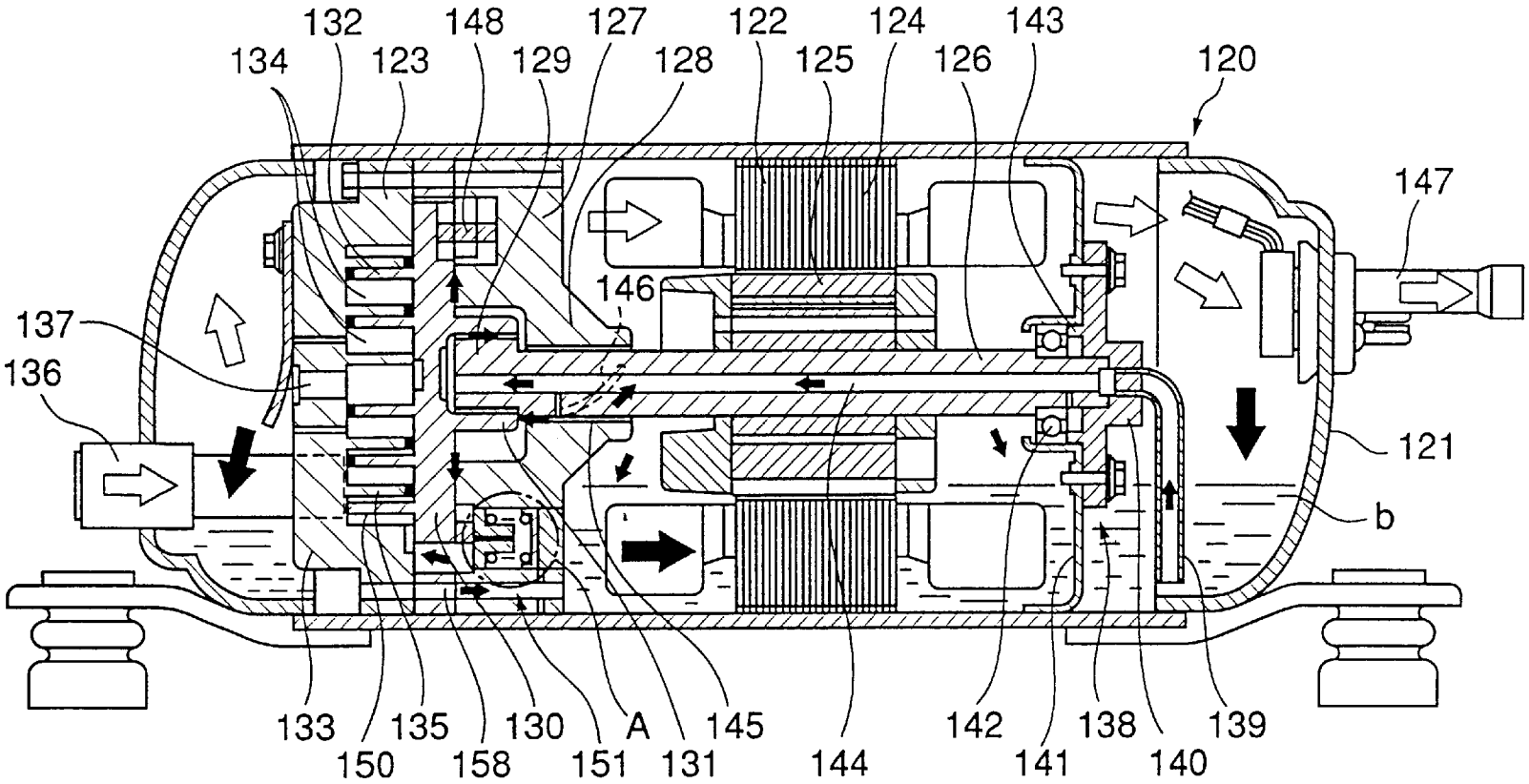
FIG. 7 is a sectional view showing the entire composition of an embodiment of the scroll compressor in accordance with another aspect of the present invention.
Figure 8:
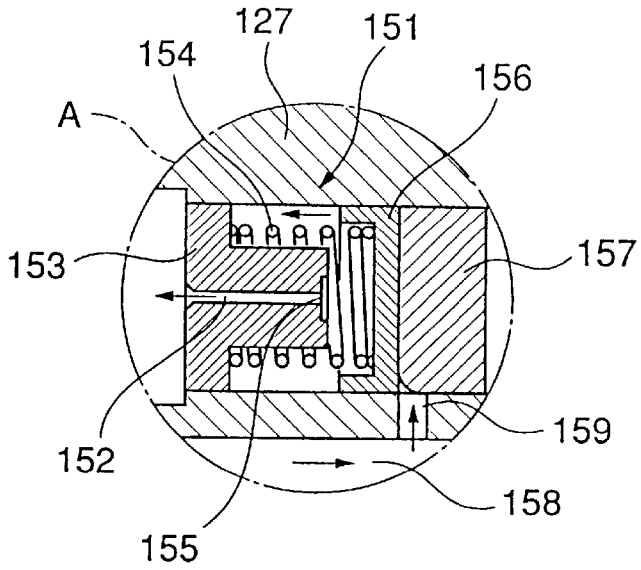
FIG. 8 is an enlarged schematic representation of portion A of FIG. 7.
Figure 9:
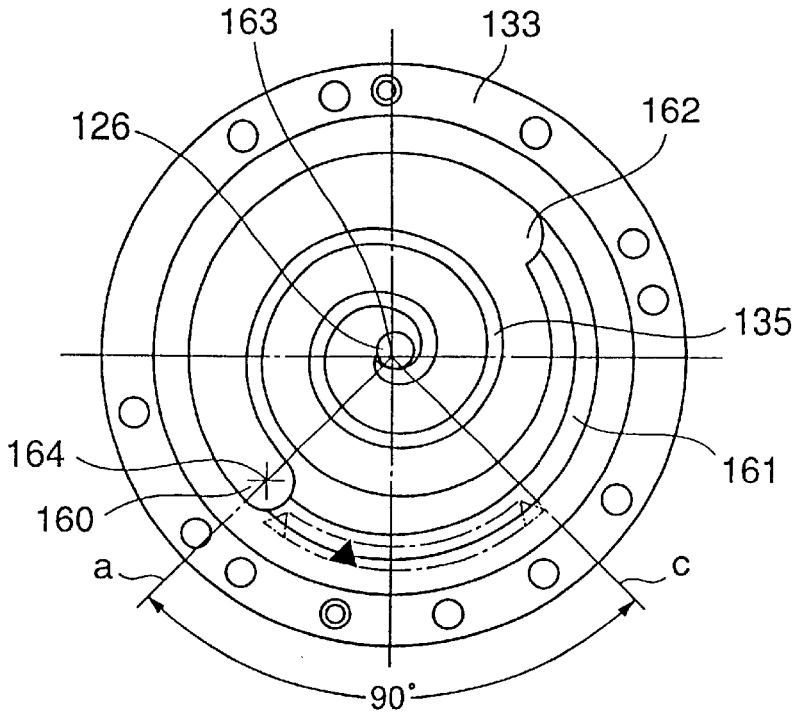
FIG. 9 is a schematic representation showing the position where a lubricant is injected to a scroll compression element of another scroll compressor in accordance with the present invention.

FIG. 7 is a sectional view showing the entire composition of an embodiment of the scroll compressor in accordance with the aspect of the invention. FIG. 8 is an enlarged schematic representation of portion A of FIG. 7. FIG. 9 is a schematic representation illustrative of the position of the oil injection of another scroll compressor in accordance with the invention.

The compressor shown in FIG. 7 is a scroll compressor 120 equipped with a cylindrical hermetic housing 121 having its both ends closed. Housed in the hermetic housing 121 are an electric element 122 and a scroll compression element 123 driven by the electric element 122.

The electric element 122 has a stator 124 fixed in the hermetic housing 121 and a rotor 125 positioned at the center of the stator 124. A rotating shaft 126 oriented in the direction of the axial center of the hermetic housing 121 is connected to the center of the rotor 125 in a penetrating fashion, and one end thereof penetrates the center of a support frame 127 supporting the scroll compression element 123 so that it is rotatably supported. In this case, the support frame 127 is connected and secured to the inner wall surface of the hermetic housing 121. The middle portion near one end of the rotating shaft 126 is rotatably supported by a bearing 128 of the support frame 127, and the rotor 125 is supported on the inner wall surface of the hermetic housing 121 via the rotating shaft 126 and the support frame 127.

The central part of one end of the rotating shaft 126 penetrating the support frame 127 is formed as a pin or crank 129 provided eccentrically in relation to the axial center of the rotating shaft 126. A swivel scroll 130 is joined to the pin 129. The swivel scroll 130 is provided with a boss hole 131 in which the pin 129 is inserted for connection to the center of one side surface of a discoid panel board, and a spiral lap 132 formed on the other side surface of the panel board.

A stationary scroll 133 is joined to the support frame 127. The stationary scroll 133 has a spiral lap 135 positioned in a zigzag fashion with respect to the lap 132 of the swivel scroll 130 so as to form a plurality of compression chambers 134.

Connected to the side wall surface of the stationary scroll 133 is an intake pipe 136 for refrigerant gas that penetrates the hermetic housing 121. Provided at the center of the stationary scroll 133 is a discharge port 137 for discharging a compressed refrigerant gas into the hermetic housing 121.

The intake side of the scroll compression element 123 of the refrigerant gas introduced through the intake pipe 136, the rear surface of the swivel scroll 130, i.e. the surface of the side where the boss hole 131 of the panel board is located, and the support frame 127 are in communication at the peripheral portion of the panel board of the swivel scroll 130. Hence, the pressure among those places is nearly as low as that at the foregoing refrigerant gas intake side and it is lower than the pressure in the hermetic housing 121.

A differential lubricating portion 138 is provided on the other end of the rotating shaft 126. The lubricating portion 138 is installed in the hermetic housing 121 to rotatably support the rotating shaft 126 and it is equipped with an auxiliary support frame 141 having an auxiliary bearing 140 with an oil introducing pipe 139 attached thereto. A bearing 142 is installed between the auxiliary support frame 141 and the rotating shaft 126, a receiving portion 143 of the bearing 142 being provided on the auxiliary bearing 140.

The rotating shaft 126 has an oil feed passage 144 extending from one end to the other end thereof. A small hole 145 communicating the oil feed passage 144 with the sliding surface of the bearing 128 is provided in the middle of the portion where the rotating shaft 126 is rotatably supported by the bearing 128. A spiral groove 146 in communication with the small hole 145 is provided in the surface of the rotating shaft 126, beginning from the outlet of the small hole 145 and extending toward the electric element 122 until the portion where the rotating shaft 126 is rotatably supported by the bearing 128. The lubricant that has left one end of the rotating shaft 126 gas-seals the boss hole 131 and the sliding surface of the pin 129, and the lubricant that has passed through the small hole 145 flows through the groove 146 to lubricate the sliding surface and also to gas-seal the sliding surface on the side of the scroll compression element 123 from the small hole 145.

The hermetic housing 121 is filled with the lubricant "b" up to a predetermined level. The lubricant "b" is sucked up from the lubricating portion 138 by the pressure differential mentioned above and it passes through the oil feed passage 144 provided in the rotating shaft 126 to be fed to respective sliding portions including the bearing 128. The lubricant is circulated for repeated use.

According to the invention, an oil injection mechanism 151 for injecting and supplying the lubricant is provided in the vicinity of an intake position 150 where the refrigerant gas is introduced from outside the hermetic housing 121 into the scroll compression element 123 via the intake pipe 136.

As shown in FIG. 8, the oil injection mechanism 151 is fixed to the support frame 127; it is composed of an oil nozzle 153 for injecting a lubricant through an oil feed passage 152 and a valve 156 that opens/closes an oil feed passage inlet 155 of the oil nozzle 153 by utilizing the elasticity of a spring 154. Reference numeral 157 denotes a fixing plug for fixing the oil injection mechanism 151, reference numeral 158 denotes a lubricant return passage, and reference numeral 159 denotes a lubricant branch passage. The oil injection mechanism 151 may be fixed at other location than the support frame 127; it may be secured, for example, to the stationary scroll 133.

The valve 156 shown in FIG. 7 and FIG. 8 is shaped like a cap that is capable of housing a part of the spring 154; it may, however, be shaped like a plate. In other words, there is no particular restriction on the shape of the valve. The clearance between the valve 156 and the support frame 127 fixing the valve 156, the diameter and the length of the oil feed passage 152 are to be determined properly.

When the operation of the horizontal type scroll compressor 120 having the constitution described above is begun, the refrigerant gas is sucked in through the intake pipe 136 to the intake position 150 of the outer peripheral portion of the scroll compression element 123, and compressed as it gradually moves toward the center of the scroll compressor. The refrigerant gas is discharged into the hermetic housing 121 through the discharge port 137 provided at the center of the stationary scroll 133 and the accompanying lubricant is separated in this space, thus suppressing pulsation.

The discharged gas flows through passages (not shown) provided in the stationary scroll 133 and the support frame 127 as indicated by the white arrows and reaches the electric element 122 side. And the lubricant in the refrigerant gas is further separated primarily by the centrifugal force generated by the rotation of the rotor 125 and by the baffle plate effect due to the stator 124, the auxiliary support frame 141, etc., then the refrigerant gas from which the lubricant has been separated is discharged out of the hermetic housing 121 through a discharge pipe 147. The separated lubricant flows as indicated by the black arrows and accumulates at the bottom of the hermetic housing 121 and it is circulated for repeated use.

Although it is not illustrated, the refrigerant gas intake side, the rear surface of the swivel scroll 130, and the support frame 127 are in communication; hence, the pressure among those places is substantially as low as that at the refrigerant gas intake side and it is lower than the pressure in the hermetic housing 121. This pressure differential causes the lubricant "b" to be sucked up through the oil introducing pipe 139 of the lubricating portion 138 and supplied under high pressure via the oil feed passage 144 provided in the rotating shaft 126, as indicated by the black arrows. A part of the supplied high-pressure lubricant passes through the small hole 145 as indicated by the black arrows and flows through the groove 146 toward the electric element 122 to lubricate sliding surfaces before it reaches the bottom of the hermetic housing 121. The clearance between the rotating shaft 126 and the bearing 128 is extremely small. The clearance is set, for example, to approximately 10 to 30 (m; hence, the sliding portions of the rotating shaft 126 and the bearing 128 on the side of the scroll compression element 123 from the small hole 145 is well gas-sealed.

The high-pressure lubricant leaving one end of the rotating shaft 126 gas-seals the boss hole 131 and the sliding surface of the pin 129. After that, these lubricants flow between the swivel scroll 130 and the support frame 127 as indicated by the black arrows to lubricate the groove of an Oldham ring 148, then flows along the outer periphery of the panel board of the swivel scroll 130 to be supplied to the refrigerant gas intake side in the scroll compression element 123 to lubricate sliding surfaces. The lubricant is then discharged together with the compressed gas through the discharge port 137 into the hermetic housing 121, and separated from the compressed gas before reaching the bottom of the hermetic housing 121.

The Oldham ring 148 is installed between the support frame 127 and the swivel scroll 130; it is revolved on a circular orbit by being driven by the electric element 122 so that the swivel scroll 130 does not rotate with respect to the stationary scroll 133.

As long as the rotational speed of the rotating shaft 126 is high, this lubricating system is good enough to sufficiently lubricate the sliding surfaces of the scroll compression element 123. If the rotational speed of the rotating shaft 126 is low, then this lubricating system is not good enough; therefore, the oil injection mechanism 151 is actuated to inject and supply the lubricant if the rotational speed of the rotating shaft 126 is low.

The pressure in the hermetic housing 121 acts, via the lubricant, on the rear surface on the side of the fixing plug 157 of the valve 156 of the oil injection mechanism 151. When the difference between the pressure in the hermetic housing 121 and the pressure in the vicinity of the refrigerant gas intake position 150 acting on the outlet side of the oil nozzle 153 is small, the high elasticity of the spring 154 causes the valve 156 to push toward the fixing plug 157 to keep the oil feed passage inlet 155 open. Therefore, the lubricant held in the hermetic housing 121 flows in the direction indicated by the arrows via the lubricant return passage 158 and the lubricant branch passage 159, passes through the intake position 150 before it is injected to the scroll compression element 123.

When the pressure differential is high, the pressure differential causes the valve 156 to overcome the elasticity of the spring 154 and moves toward the oil nozzle 153, and the inner surface of the valve 156 comes in contact with the oil feed passage inlet 155 to close it, thus stopping the injection of the lubricant.

As set forth above, it is important to adjust the elasticity of the spring 154 so that, if the rotational speed of the rotating shaft 126 is high and the pressure in the hermetic housing 121 becomes higher than a predetermined level, then the injection of the lubricant by the oil injection mechanism is stopped, and if the rotational speed of the rotating shaft 126 is low and the pressure in the hermetic housing 121 becomes lower than the predetermined level, then the lubricant is injected by the oil injection mechanism 151.

The amount of injected lubricant is preferably about 3% at the maximum for the elimination volume per unit time. The absence of the oil injection deteriorates the sealing performance; however, if the injection amount exceeds 3%, then the volume effect deteriorates. Hence, the amount of the lubricant to be injected should be determined to obtain the best possible balance of the two factors.

The pressure differential for actuating the oil injection mechanism 151 is not particularly restricted. It is preferable, however, to normally set the pressure differential so that the valve 156 opens the oil feed passage inlet 155 to inject the lubricant when the pressure differential is lower than the range from about 4 to about 8 kgf/cm$^2$.

FIG. 9 shows the position where the lubricant is injected to the scroll compression element of another scroll compressor in accordance with the present invention. The oil injection mechanism 151 (not shown) is provided at a location in the vicinity of a communication passage 161 located between a first suction inlet 160 provided on the stationary scroll 133 for taking the refrigerant gas into the scroll compression element 123 from outside the hermetic housing 121 and a second suction inlet 162 that is provided on the stationary scroll 133 at the position opposed to the first suction inlet 160 and that is in communication with the communication passage 161. In addition, the oil injection mechanism 151 is provided at the location in the vicinity of the communication passage 161 between a line "a" connecting a center 163 of the rotating shaft 126 and a center 164 of the first suction inlet 160 and a line "c" drawn 90 degrees away from the center 163 of the rotating shaft 126 toward the second suction inlet 162, using the line "a" as the baseline. The lubricant is injected from the oil injection mechanism 151 to the communication passage 161 located between the line "a" and the line "c" (an example of the injecting position is indicated by the black arrow). Except this part of constitution, this scroll compressor in accordance with the invention shares the same constitution as that of the scroll compressor 120 shown in FIG. 7 and FIG. 8.

The refrigerant gas is introduced through the two places, namely, the first suction inlet 160 and the second suction inlet 162, so that the intake efficiency of the refrigerant gas is improved. Moreover, the lubricant that has been injected at the particular position of the communication passage 161 is uniformly supplied to the scroll compression element 123 by the refrigerant gas that has been taken in; therefore, the sealing performance and lubricating performance are further improved.

Specific examples of the refrigerant employed in the present invention are HFC-based refrigerants such as 1, 1, 1, 2-tetrafluoroethane (R134a) simple substance, a mixed refrigerant (R407C) of R134a, difluoromethane (R-32), and pentafluoroethane (R-125), and the mixed refrigerant (R410A) of R-32 and R-125, or HCFC-based refrigerants such as a simple substance or a mixed refrigerant of hydrochloro-difluoromethane (R22).

Specific examples of the lubricant employed in the present invention are ester-based oils or ether-based oils compatible with the refrigerants mentioned above, or alkylbenzene-based oils incompatible with the refrigerants, or mixtures of these.

The above description of the scroll compressor in accordance with the present invention refers to a horizontal type scroll compressor. The scroll compressor in accordance with the invention, however, is not limited to the horizontal type; the invention is applicable also to a vertical scroll compressor or other types of scroll compressors.

The scroll compressor in accordance with the invention is equipped with the oil injection mechanism of the simple construction that makes it easy to avoid insufficient lubricant supplied to the scroll compression element when the number of revolutions of the rotating shaft decreases thereby to permit stable operation with good sealing and lubricating performance, high reliability, and high compression efficiency over an extended period of time.

Figure 11:
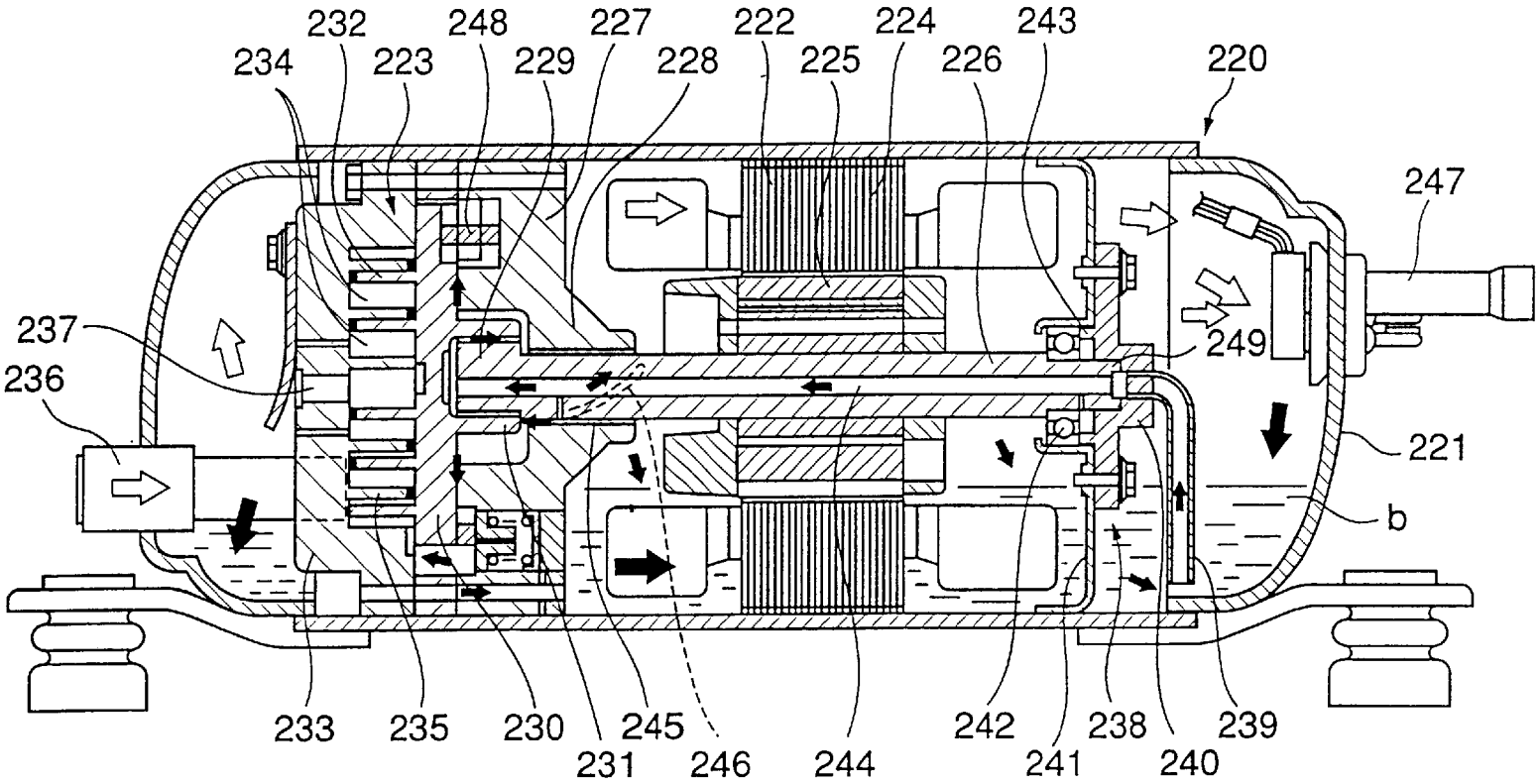
FIG. 11 is a sectional view showing the entire composition of an embodiment of the scroll compressor in accordance with still another aspect of the present invention.
Figure 12:
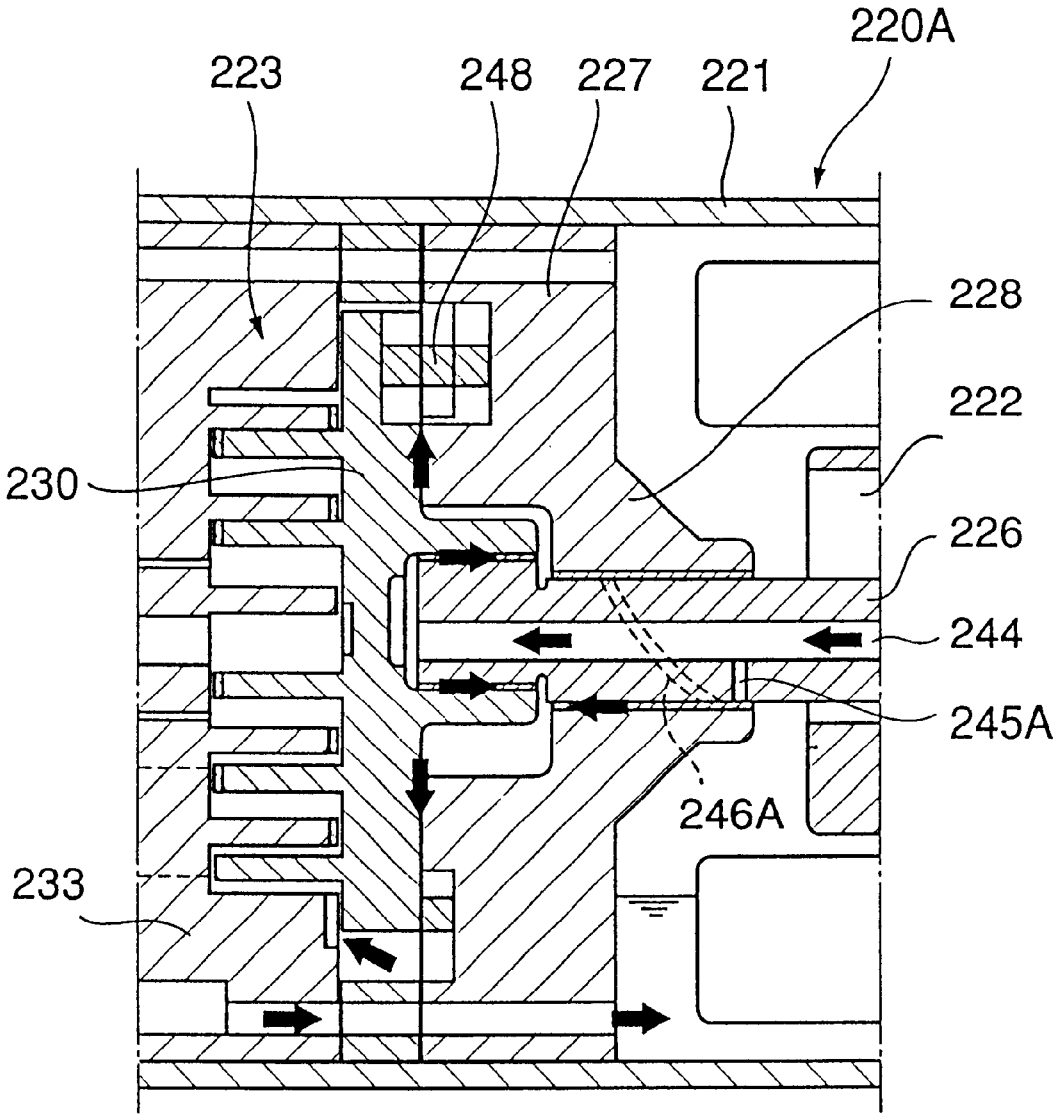
FIG. 12 is an enlarged schematic representation of a bearing and a rotating shaft of another scroll compressor in accordance with the present invention.

Referring now to FIG. 11 and FIG. 12, the invention related to claim 12 through claim 18 of the present application will be described. The compressor shown in FIG. 10 poses another problem in that it needs to be equipped with the oil releasing unit to avoid excessive lubricant supply since the use of the pump 108 for supplying the lubricant causes the amount of the lubricant supplied to vary according to the number of revolutions of the rotating shaft 106. This results in problems such as more complication of the entire system, more power consumed, and higher cost.

As a solution to the problem, there has been proposed the horizontal type scroll compressor under Japanese Examined Patent Publication No. 3-175186. As previously mentioned, this type does not employ the pump for supplying a lubricant, and it discharges compressed gas into a hermetic housing; it has a through hole in the swivel scroll to communicate an appropriate compression chamber among the scroll compression elements, the rear surface of the swivel scroll, and the support frame so as to set the pressure among them to an appropriate medium pressure, e.g. 8 to 9 kg/cm$^2$ that is lower than the pressure, e.g. 15 to 25 kg/cm$^2$, in the hermetic housing. By utilizing the pressure differential, the lubricant is sucked up and passed through the oil feed passage provided in the rotating shaft to be supplied to respective sliding parts including the support frame. The swivel scroll is pressed against a stationary scroll by the foregoing pressure to bring them into contact so as to provide gas seal thereby to compress the refrigerant gas.

This scroll compressor, however, has been presenting the following problem although the lubrication by the lubricant is satisfactory. The stationary scroll and the swivel scroll are brought in direct contact with each other by the pressure to provide the gas seal to compress the refrigerant gas; hence, more power is consumed, and the both stationary scroll and the swivel scroll need to be composed of iron casting or a combination of iron casting and aluminum or the like, making it impossible to use aluminum or an aluminum alloy for both stationary and swivel scrolls.

To solve the problem, according to yet another aspect of the invention, there is provided a horizontal scroll compressor that provides high refrigerating performance and ensures stable operation for a long time, that is able to ensure stable supply of a lubricant even when the number of revolutions of the rotating shaft varies, and that permits the use of aluminum or an aluminum alloy as the component material for both stationary and swivel scrolls thereof. This type of scroll compressor employs the system in which compressed gas is discharged into a hermetic housing rather than employing a pump for supplying a lubricant. The scroll compressor utilizes the pressure differential to suck up the lubricant and supplies it to sliding parts including the support frame via an oil feed passage provided in the rotating shaft. The scroll compressor does not, however, press the swivel scroll against the stationary scroll to bring them in contact; conversely, it sets the swivel scroll away from the stationary scroll to compress the refrigerant gas under the gas-sealed condition.

The inventors have enthusiastically studied to solve the problem and found a solution thereto, which has led to the accomplishment of the present invention. According to the solution, the refrigerant gas intake side, the rear surface of the swivel scroll, and the support frame are placed in communication and the pressure among them is set low. The refrigerant gas is compressed under a gas-sealed condition while holding the swivel scroll away from the stationary scroll, and the lubricant is introduced from the lubricating portion and fed to sliding parts including a bearing via the oil feed passage provided in the rotating shaft, the lubricant being circulated for repeated use.

An embodiment of the invention will be described in detail in conjunction with the drawing given in FIG. 11. FIG. 11 is a sectional view showing the entire composition of a horizontal type scroll compressor in accordance with the invention. FIG. 12 is an enlarged schematic representation of the bearing and the rotating shaft of the horizontal type scroll compressor of another embodiment in accordance with the present invention.

The compressor shown in FIG. 11 is a scroll compressor 220 equipped with a cylindrical hermetic housing 221 having its both ends closed. Housed in the hermetic housing 221 are an electric element 222 and a scroll compression element 223 driven by the electric element 222.

The electric element 222 has a stator 224 fixed in the hermetic housing 221 and a rotor 225 positioned at the center of the stator 224. A rotating shaft 226 oriented in the direction of the axial center of the hermetic housing 221 is connected to the center of the rotor 225 in a penetrating fashion, and one end thereof penetrates the center of a support frame 227 supporting the scroll compression element 223 so that it is rotatably supported. In this case, the support frame 227 is connected and secured to the inner wall surface of the hermetic housing 221. The middle portion near one end of the rotating shaft 226 is rotatably supported by a bearing 228 of the support frame 227, and the rotor 225 is supported on the inner wall surface of the hermetic housing 221 via the rotating shaft 226 and the support frame 227.

The central part of one end of the rotating shaft 226 penetrating the support frame 227 is formed as a pin or crank 229 provided eccentrically in relation to the axial center of the rotating shaft 226. A swivel scroll 230 is joined to the pin 229. The swivel scroll 230 is provided with a boss hole 231 in which the pin 229 is inserted for connection to the center of one side surface of a discoid panel board, and a spiral lap 232 formed on the other side surface of the panel board.

A stationary scroll 233 is joined to the support frame 227. The stationary scroll 233 has a spiral lap 235 positioned in a zigzag fashion with respect to the lap 232 of the swivel scroll 230 so as to form a plurality of compression chambers 234.

Connected to the side wall surface of the stationary scroll 233 is an intake pipe 236 for refrigerant gas that penetrates the hermetic housing 221. Provided at the center of the stationary scroll 233 is a discharge port 237 for discharging a compressed refrigerant gas into the hermetic housing 221.

The intake side of the scroll compression element 223 of the refrigerant gas introduced through the intake pipe 236, the rear surface of the swivel scroll 230, i.e. the surface of the side where the boss hole 231 of the panel board is located, and the support frame 227 are in communication at the peripheral portion of the panel board of the swivel scroll 230. Hence, the pressure among those places is substantially as low as that at the foregoing refrigerant gas intake side and it is lower than the pressure in the hermetic housing 221.

A differential lubricating portion 238 is provided on the other end of the rotating shaft 226. The lubricating portion 238 is installed in the hermetic housing 221 to rotatably support the rotating shaft 226 and it is equipped with an auxiliary support frame 241 having an auxiliary bearing 240 with an oil introducing pipe 239 attached thereto. A bearing 242 is installed between the auxiliary support frame 241 and the rotating shaft 226, a receiving portion 243 of the bearing 242 being provided on the auxiliary bearing 240.

The rotating shaft 226 has an oil feed passage 244 extending from one end to the other end thereof. A small hole 245 communicating the oil feed passage 244 with the sliding surface of the bearing 228 is provided in the middle of the portion where the rotating shaft 226 is rotatably supported by the bearing 228. A spiral groove 246 in communication with the small hole 245 is provided in the surface of the rotating shaft 226, beginning from the outlet of the small hole 245 and extending toward the electric element 222 until it reaches a point slightly beyond the portion where the rotating shaft 226 is rotatably supported by the bearing 228. The lubricant that has left one end of the rotating shaft 226 gas-seals the boss hole 231 and the sliding surface of the pin 229, and the lubricant that has passed through the small hole 245 flows through the groove 246 to lubricate the sliding surfaces and also to gas-seal the sliding surface on the side of the scroll compression element 223 from the small hole 245.

The hermetic housing 221 is filled with the lubricant "b" up to a predetermined level. The lubricant "b" is sucked up from the lubricating portion 238 by the pressure differential mentioned above and it passes through the oil feed passage 244 provided in the rotating shaft 226 to be fed to respective sliding portions including the bearing 228. The lubricant is circulated for repeated use.

When the operation of the horizontal type scroll compressor 220 having the constitution described above is begun, the refrigerant gas is taken in through the intake pipe 236 to the outer peripheral portion of the scroll compression element 223, and compressed as it gradually moves toward the center of the scroll compressor. The refrigerant gas is discharged into the hermetic housing 221 through the discharge port 237 provided at the center of the stationary scroll 233 and the accompanying lubricant is separated in this space, thus suppressing pulsation.

The discharged gas flows through passages (not shown) provided in the stationary scroll 233 and the support frame 227 as indicated by the white arrows and reaches the electric element 222 side. And the lubricant in the refrigerant gas is further separated primarily by the centrifugal force generated by the rotation of the rotor 225 and by the baffle plate effect due to the stator 224, the auxiliary support frame 241, etc., then the refrigerant gas from which the lubricant has been separated is discharged out of the hermetic housing 221 through a discharge pipe 247. The separated lubricant flows as indicated by the black arrows and accumulates at the bottom of the hermetic housing 221 and it is circulated for repeated use.

The refrigerant gas intake side, the rear surface of the swivel scroll 230, and the support frame 227 are placed in communication; hence, the pressure among those places is substantially as low as that at the refrigerant gas intake side and it is lower than the pressure in the hermetic housing 221. This pressure differential causes the lubricant "b" to be sucked up through the oil introducing pipe 239 of the lubricating portion 238 and supplied under high pressure via the oil feed passage 244 provided in the rotating shaft 226, as indicated by the black arrows. A part of the supplied high-pressure lubricant passes through the small hole 245 as indicated by the black arrows and flows through the groove 246 toward the electric element 222 to lubricate sliding surfaces before it reaches the bottom of the hermetic housing 221. The clearance between the rotating shaft 226 and the bearing 228 is extremely small. The clearance is set, for example, to approximately 10 to 30 (m; hence, the sliding portions of the rotating shaft 226 and the bearing 228 on the side of the scroll compression element 223 from the small hole 245 is well gas-sealed.

The high-pressure lubricant leaving one end of the rotating shaft 226 gas-seals the boss hole 231 and the sliding surface of the pin 229. After that, these lubricants flow between the swivel scroll 230 and the support frame 227 as indicated by the black arrows to lubricate the groove of an Oldham ring 248, then flows along the outer periphery of the panel board of the swivel scroll 230 to be supplied to the refrigerant gas intake side in the scroll compression element 223 to lubricate sliding surfaces. The lubricant is then discharged together with the compressed gas through the discharge port 237 into the hermetic housing 221, and separated from the compressed gas before reaching the bottom of the hermetic housing 221.

The Oldham ring 248 is installed between the support frame 227 and the swivel scroll 230; it is revolved on a circular orbit by being driven by the electric element 222 so that the swivel scroll 230 does not rotate with respect to the stationary scroll 233.

As mentioned above, the pressure between the rear surface of the swivel scroll 230 and the support frame 227 is substantially as low as that at the refrigerant gas intake side, so that the swivel scroll 230 is not pressed against the stationary scroll 233. Conversely, the swivel scroll 230 is set away from the stationary scroll 233; therefore, it is necessary to compress the refrigerant gas under the gas-sealed condition generated by providing a spring-operated gas sealing device on the lap distal ends of the swivel scroll 230 and the stationary scroll 233, respectively, to provide a lubricant therebetween. This ensures an advantage of higher compression efficiency obtained by improved gas sealing in the scroll compression element 223 and it also allows the use of aluminum or an aluminum alloy for the stationary scroll 233 and the swivel scroll 230.

The bearing 242 is installed between the auxiliary support frame 241 of the lubricating portion 238 and the rotating shaft 226, and the receiving portion 243 of the bearing 242 is provided on the auxiliary bearing 240. This provides an advantage in that the rotating shaft 226 rotates stably and smoothly, leading to higher compression efficiency with resultant reduced vibration or noise.

It is possible to prevent the refrigerant gas from entering the lubricant by properly adjusting a gap 249 between the sliding portion of the rotating shaft 226 and that of the sliding portion of the auxiliary bearing 240. If the gap 249 is too large, then the gas may enter the lubricant; conversely, if the gap 249 is too small, then the resistance to the rotating shaft 226 may become too high. It is required, therefore, to properly adjust the gap 249.

The rotating shaft 226 of a horizontal type scroll compressor 220A of another embodiment in accordance with the present invention shown in FIG. 12 is provided with a small hole 245A that is located on the side of the electric element 222 of the portion where the rotating shaft 226 is rotatably supported by the bearing 228 and that extends from the oil feed passage 244 to the sliding surface of the bearing 228. A spiral groove 246A in communication with the small hole 245A is formed in the surface of the rotating shaft 226; it begins at the outlet of the small hole 245A and extends toward the scroll compression element 223 to the middle of the portion where the rotating shaft 226 is rotatably supported by the bearing 228. The spiral direction of the spiral groove 246A is opposite from the rotational direction of the rotating shaft 226. Except for this part of constitution, this type of scroll compressor shares the same constitution as that of the horizontal scroll compressor 220 shown in FIG. 11.

The pressure differential causes the lubricant "b" to be supplied under high pressure via the oil feed passage 244. As indicated by the black arrows, a part of the supplied high-pressure lubricant passes through the small hole 245A, flows through the groove 246A toward the scroll compression element 223 to lubricate the sliding surfaces and also to gas-seal the sliding surface of the portion of the rotating shaft 226 on the side of the scroll compression element 223 from the small hole 245A, and the sliding surface of the bearing 228. As in the case of the scroll compressor 220, after that, these lubricants flow between the swivel scroll 230 and the support frame 227 as indicated by the black arrows to lubricate the groove of the Oldham ring 248, then it is supplied into the scroll compression element 223 to lubricate sliding surfaces. The lubricant is then discharged together with the compressed gas through the discharge port 237 into the hermetic housing 221, and separated from the compressed gas before reaching the bottom of the hermetic housing 221. This provides an advantage in that the gas sealing in the scroll compression element 223 is further improved, leading to higher compression efficiency.

Hitherto, many compressors for refrigerators, vending machines, and showcases have been using dichlorodifluoromethane (R12). The R12 has been specified as a CFC control item because of its high possibility of damage to the ozone layer since if it is released into the air and reaches the ozone layer in the sky, it damages the ozone layer. The damage to the ozone layer is attributable to the chlorine radical (CI) contained in a refrigerant.

Specific examples of the refrigerant employed in the present invention are HFC-based refrigerants such as 1, 1, 1, 2-tetrafluoroethane (R134a) simple substance, a mixed refrigerant (R407C) of R134a, difluoromethane (R-32), and pentafluoroethane (R-125), and the mixed refrigerant (R410A) of R-32 and R-125, or HCFC-based refrigerants such as a simple substance or a mixed refrigerant of hydrochloro-difluoromethane (R22).

Specific examples of the lubricant employed in the present invention are ester-based oils or ether-based oils compatible with the refrigerants mentioned above, or alkylbenzene-based oils incompatible with the refrigerants, or mixtures of these.

The scroll compressor in accordance with the invention does not employ a pump for supplying a lubricant; it discharges the compressed gas into the hermetic housing. By making use of the pressure differential, the lubricant is supplied, via the oil feed passage provided in the rotating shaft, to the sliding parts such as the support frame so as to lubricate them, thus circulating the lubricant for reuse. The swivel scroll is not pressed against the stationary scroll to bring them in contact.

On the contrary, the swivel scroll is set away from the stationary scroll, and the refrigerant gas is compressed under the gas-sealed condition. Hence, aluminum or an aluminum alloy can be used as the constituent materials for both stationary and swivel scrolls. Moreover, even when the number of revolutions of the rotating shaft varies, the scroll compressor enables stable supply of a lubricant. Thus, the scroll compressor provides high refrigerating performance, consumes less power, and ensures stable operation for a long time.

What is claimed is:

1. A scroll compressor comprising:

an electric element having a rotating shaft and a scroll compression element driven by said electric element, both said electric element and scroll compression element housed in a hermetic housing;

a support frame in said hermetic housing to support said scroll compression element and having a bearing portion for rotatably supporting said rotating shaft a supply of lubricant in said hermetic housing;

a differential pressure lubricating portion on said rotating shaft in communication with said supply of lubricant and including an oil passage in said shaft having an outlet;

wherein said scroll compression element includes a stationary scroll having a discharge port for compressed gas and a spiral lap on the rear surface thereof, and a swivel scroll having a spiral lap that is rotated with respect to said stationary scroll by being driven by said electric element, the laps of said stationary scroll and said swivel scroll being meshed with each other to form a plurality of compression chambers, a refrigerant gas supplied through a refrigerant gas intake from outside said hermetic housing to be compressed in said compression chambers and discharged into said hermetic housing through said discharge port of said stationary scroll before it is discharged out of said hermetic housing;

the refrigerant gas supplied from the intake communicating with the rear surface of said swivel scroll and said support frame to set the pressure therebetween lower than the pressure in the hermetic housing and at the discharge port of said stationary scroll, the pressure in the hermetic housing forcing the lubricant from said lubricating portion to the outlet of said rotating shaft to gas-seal respective sliding portions including said bearing portion and to allow the positioning of said stationary and swivel scrolls away from each other; and wherein a hole is provided that extends from said oil feed passage to the sliding surface of said bearing portions, and a spiral groove is in the surface of said rotating shaft on the side of said electric element from said hole so that the lubricant, which has passed through said hole, flows through said groove to lubricate and to gas-seal a sliding surface on the side of said scroll compression element from said hole.

2. A scroll compressor according to claim 1, wherein a pin which is provided on a distal end of said rotary shaft and the center of which is eccentric to the axial center of said rotating shaft is inserted in a boss hole drilled at the center of the rear surface of said swivel scroll, and said boss hole and a sliding portion of said pin are gas-sealed with the lubricant supplied from said lubricating portion.

3. A scroll compressor according to claim 1 or 2, wherein said hole extends from said oil feed passage to the sliding surface of said bearing portion in the vicinity of the end of said bearing portion on the side of said electric element, and said spiral groove extends in the opposite direction from the rotational direction of said rotating shaft in the surface of said rotating shaft on the side of said scroll compression element from said hole with the end point of said spiral groove positioned within said bearing portion so that the lubricant which has passed through said small hole flows through said groove to lubricate the sliding surface and to gas-seal the sliding surface on the side of said scroll compression element from said end point.

4. A scroll compressor according to claims 1 or 2, wherein said lubricating portion comprises an auxiliary support frame having an auxiliary bearing in said hermetic housing to rotatably support said rotating shaft and having an oil introducing pipe attached thereto; a bearing installed between said auxiliary support frame and said rotating shaft, and a receiving portion for said bearing on said auxiliary bearing.

5. A scroll compressor according to claims 1 or 2, wherein the gap between said rotating shaft and the sliding portion of said auxiliary bearing is adjusted to prevent gas from entering the lubricant.

6. A scroll compressor according to claims 1 or 2, wherein said stationary scroll and said swivel scroll are made of aluminum or an aluminum alloy.

* * * * *